US007866674B2

(12) United States Patent
Weber et al.

(10) Patent No.: US 7,866,674 B2
(45) Date of Patent: Jan. 11, 2011

(54) ELECTRICALLY HEATED ICE SKATES

(75) Inventors: Tory Weber, Calgary (CA); Benoit Talbot, St. Malachie (CA); David Croteau, Saint-Etienne (CA); Stephan Lachevrotiere, St. Augustin (CA); Pierre Harvey, St. Ferreol (CA)

(73) Assignee: Thermablade Hockey Corp., Westmount, Quebec (CA)

( * ) Notice: Subject to any disclaimer, the term of this patent is extended or adjusted under 35 U.S.C. 154(b) by 434 days.

(21) Appl. No.: 11/851,681

(22) Filed: Sep. 7, 2007

(65) Prior Publication Data

US 2009/0066042 A1 Mar. 12, 2009

(51) Int. Cl.
*A63C 1/00* (2006.01)
*A63C 11/00* (2006.01)
*H05B 3/00* (2006.01)

(52) U.S. Cl. ..... 280/11.12; 280/811; 219/211

(58) Field of Classification Search ..... 280/11.12, 280/14.25, 14.26, 811; 219/211
See application file for complete search history.

(56) References Cited

U.S. PATENT DOCUMENTS 2,692,326 A * 10/1954 Crowell ..... 219/211
3,119,921 A 1/1964 Czaja
3,866,927 A * 2/1975 Tvengsberg ..... 280/11.12
3,906,185 A * 9/1975 Gross et al. ..... 219/211
3,913,312 A 10/1975 Numabe
3,936,755 A 2/1976 Sheng
4,761,420 A 8/1988 Genain
5,088,749 A 2/1992 Olivieri
5,248,156 A 9/1993 Cann
5,441,305 A * 8/1995 Tabar ..... 280/809
6,485,033 B2 11/2002 Nicoletti et al.
6,669,209 B2 12/2003 Furzer
6,817,618 B2 11/2004 Furzer
6,894,893 B2 5/2005 Hidesawn
6,988,735 B2 1/2006 Furzer
2003/0107192 A1 * 6/2003 Furzer et al. ..... 280/11.12
2005/0029247 A1 * 2/2005 Furzer et al. ..... 219/490
2005/0029755 A1 2/2005 Fask

* cited by examiner

*Primary Examiner*—J. Allen Shriver, II
*Assistant Examiner*—John R Olszewski
(74) *Attorney, Agent, or Firm*—Adrian D. Battison; Ade & Company Inc.

(57) ABSTRACT

An ice skate assembly for attachment to a boot has a skate blade and a blade heating arrangement mounted within a blade support. The blade is heated by resistive heating wire attached along a groove on each side of the blade. The blade is mounted in the support by an over-molded plastic strip which engages into a slot in the support as a wedged fit. A control circuit board is encapsulated on the top edge of the blade and connects to a battery pack is carried in the rear tower of the support. The blade is attached to the support by a screw for pulling the blade longitudinally of the blade and to draw an inclined wedge member formed by the over-molding into its receptacle.

16 Claims, 7 Drawing Sheets

ELECTRICALLY HEATED ICE SKATES

The present invention relates to electrically heated ice skates and particularly to a heating system for applying the heat from a battery source to the blade.

BACKGROUND OF THE INVENTION

Common ice skates used in skating have an elongate blade which is arranged to slide along the ice surface. Attempts to minimise the friction between the blade and the ice using the application of heat to the blade are shown a number of prior US patents as follows:

U.S. Pat. No. 3,119,921 (Czaja) issued Nov. 2, 1962 discloses a resistant heating element attached as a folded resistance heating element wrapped over a top of the blade of a skate so as to apply heat along the side surfaces of the blade. A battery is mounted in the open area above the blade underneath the connection of the blade to the boot.

U.S. Pat. No. 3,866,927 (Tvengsberg) issued Feb. 18, 1975 discloses a similar arrangement where the blade is mounted in a molded holder extending from the blade to the sole of the boot. The blade may be optionally heated in which case a resistance heating element is applied apparently along the side of the blade although this is not adequately described.

U.S. Pat. No. 5,441,305 (Tabar) issued Aug. 15, 1995 discloses a heating system primarily for skis which appears to be speculative in nature and includes a number of different arrangements which could be used. In FIGS. 6 and 7 is shown the heating of a skate blade where a resistance heating wire is apparently buried inside the structure of the skate blade itself. No detail is provided as to how this might be manufactured.

All of the above patents therefore show resistance heating elements but in each case the structure is clearly speculative and no detail is provided. No product of this type has been commercially available.

U.S. Pat. Nos. 6,669,209 issued Dec. 30, 2003, 6,817,618 issued Nov. 16, 2004 and 6,988,735 issued Jan. 24, 2006 all by Furzer and all assigned to the present assignee disclose various arrangements of heated skate blade where a battery is located in a tower of the skate support attached to the skate boot and supplies power to a heating device on the blade. In this case the heating element is in the form of a transistor which fed with current in a mode so that the transistor generates heat with the transistor communicating that heat to a side of the blade or through a separate insert of high thermal conductivity.

This application relates to the subject matter disclosed and claimed in co-pending applications Ser. No. 11/780,577 entitled HEATING ARRANGEMENT FOR ICE SKATE BLADES (corresponding to Canadian Application INSERT) and Ser. No. 11/780,580 entitled MOUNTING ARRANGEMENT FOR ICE SKATE BLADES (corresponding to Canadian Application INSERT) all filed 20 Jul. 2007 by the same applicants and assigned to the same assignees, the disclosures of which are incorporated herein by reference.

SUMMARY OF THE INVENTION

It is an object of the present invention to provide an improved resistance heated skate blade.

According to a first aspect of the present invention there is provided a skate blade assembly comprising:

a skate blade member;

a support for the skate blade member for attachment of the skate blade member to a skate boot;

a resistance heating member extending along a surface of the skate blade member for applying heat to the skate blade member;

a battery power source carried on the support for supplying current to the resistance heating member;

the resistance heating member comprising an elongate electrically conductive wire of constant cross-section along which the current from the battery power source is conducted with a layer of electrically insulating material applied onto an outside peripheral surface of the wire, the wire extending in a substantially straight path along the surface of the skate blade member and the wire being against the surface so that the layer is held in direct contact with the surface to transfer heat thereto.

Preferably the conductive wire forming the resistance heating member is cylindrical. Such circular cylindrical wires are readily commercially available and form a convenient heat generating mechanism.

Preferably the resistance heating member includes a first portion of the wire along a first side surface of the skate blade member and returns in a second portion along a second opposed side surface of the skate blade member.

Preferably there is provided a heating control circuit board arranged above the skate blade member and the resistance heating member extends from a first electrical connection at the heating control circuit board along the first side surface of the skate blade member and returns along the second opposed side surface of the skate blade member.

Preferably the skate blade member includes a metal skate blade with an over-molding of plastics material with the plastics material forming a groove with a base of the groove at the surface of the metal skate blade and wherein the resistance heating member is received in the groove.

Preferably the over-molding of plastics material is applied along both sides of the metal skate blade with the plastics material forming on each side of the metal skate blade a groove with a portion of the resistance heating member received in each groove.

Preferably the over-molding of plastics material along the skate blade member forms a mounting therefor into the support.

Preferably the resistance heating member is compressed into the groove by a deformable bead of a resilient material.

Preferably the deformable bead of resilient material is compressed by insertion of the over-molding into the support and pressure on the deformable bead from a portion of the support.

Preferably the resistance heating member has one side in contact with the skate blade member and all other sides surrounded by a heat insulating plastics material.

Preferably the plastics heat insulating material is the over-molding and the bead of a plastics material.

According to a second aspect of the present invention there is provided a skate blade assembly comprising:

a skate blade member;

a support for the skate blade member for attachment of the skate blade member to a skate boot;

a resistance heating member extending along a surface of the skate blade member for applying heat to the skate blade member;

a battery power source carried on the support for supplying current to the resistance heating member;

wherein the resistance heating member has one side in contact with the skate blade member and all other sides surrounded by a heat insulating plastics material.

According to a third aspect of the present invention there is provided a skate blade assembly comprising:

a skate blade member;

a support for the skate blade member for attachment of the skate blade member to a skate boot;

a resistance heating member extending along a surface of the skate blade member for applying heat to the skate blade member;

a battery power source carried on the support for supplying current to the resistance heating member;

wherein the skate blade member includes a metal skate blade with an over-molding of plastics material;

wherein the plastics material is shaped to form a groove with a base of the groove at the surface of the metal skate blade;

and wherein the resistance heating member is received in the groove.

According to a fourth aspect of the present invention there is provided a skate blade assembly comprising:

a skate blade member;

a support for the skate blade member for attachment of the skate blade member to a skate boot;

a resistance heating member extending along a surface of the skate blade member for applying heat to the skate blade member;

a battery power source carried on the support for supplying current to the resistance heating member;

wherein the resistance heating member is compressed against a surface of the skate blade member by a deformable bead of a resilient material.

BRIEF DESCRIPTION OF THE DRAWINGS

In the accompanying drawings, which illustrate an exemplary embodiment of the present invention.

DETAILED DESCRIPTION

Figure 1:
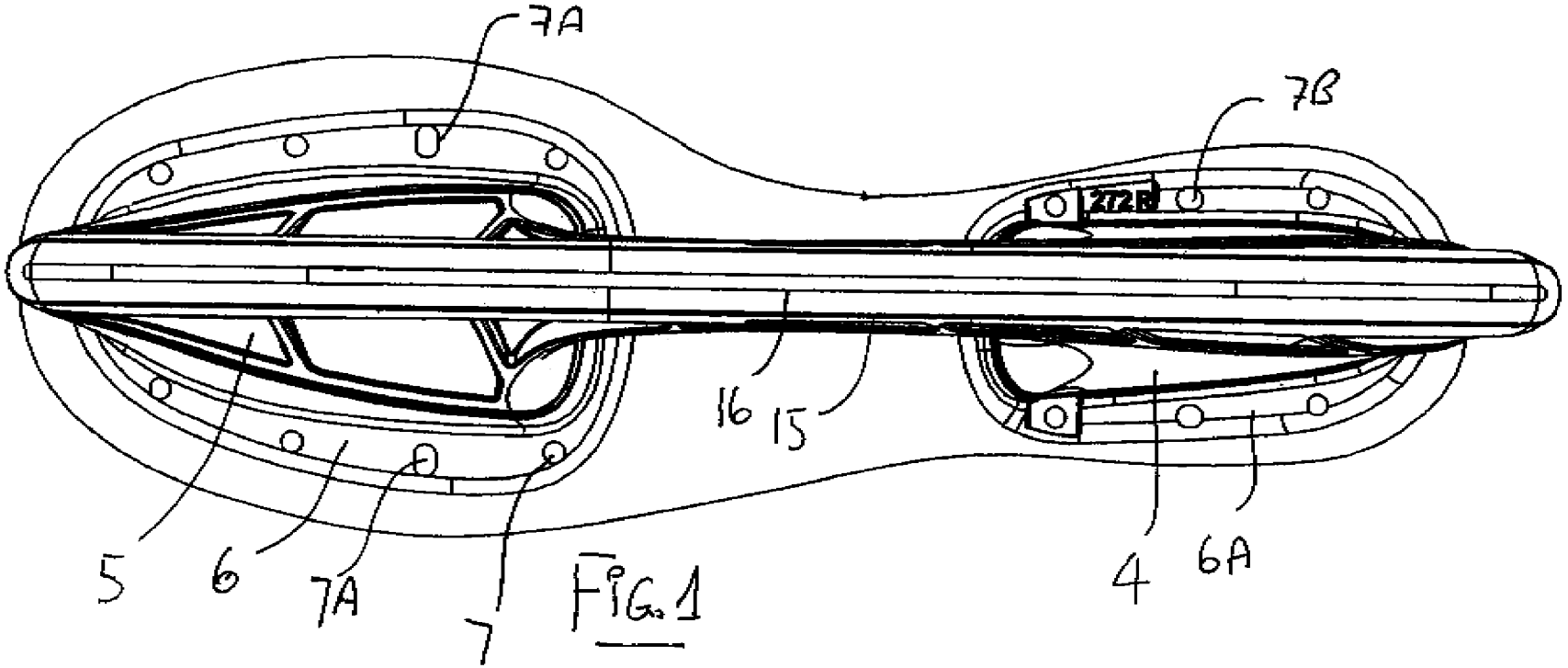
FIG. 1 is a bottom plan view of a heated skate blade according to the present invention showing the blade and mounting for attachment to a skate boot which is shown in outline only for convenience of illustration.
Figure 2:
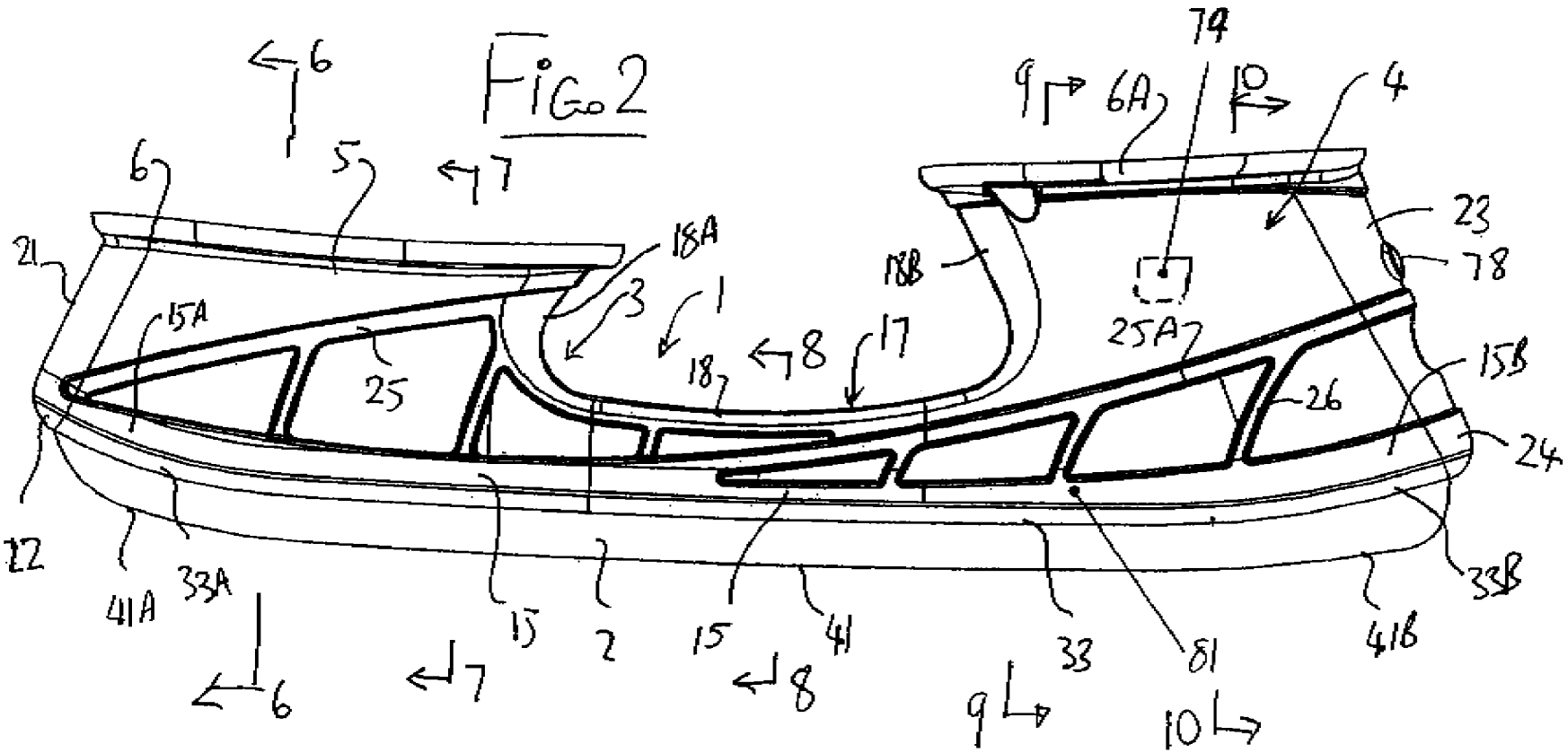
FIG. 2 is a side elevational view of the embodiment of FIG. 1 with the boot omitted for convenience of illustration.

Referring to the accompanying drawings FIGS. 1 and 2, there is illustrated an ice skate blade assembly 1. The skate blade assembly is of the conventional ice skate type having a skate blade member 2 having a metal skate blade 32 and a holder or support 3 to support the blade. The holder has a hollow heel tower 4 and a hollow toe tower 5 each having a top flange 6, 6A around the peripheral edge of the tower which fastens to the skate boot by a series of holes 7 around the flange.

The skate blade assembly 1 is generally fastened through the sole plate flange holes 7 through matching holes in the sole of an ice skate boot (not shown) with mechanical fasteners (not shown). The heel 4 and the toe 5 of the skate blade holder 3 generally are hollow.

A heating arrangement 8 in the form of a resistance heating member 100 is arranged to heat the skate blade 2 such that the heat reduces the coefficient of friction of the blade 2 on an ice surface. The heating arrangement 8 has a heat control circuit board 9 mounted on the top edge of the blade and a battery 14 and battery control circuit board 14A in the hollow heel tower 4 of the holder 3.

The circuit has a thermistor 12 which controls the temperature of the blade by controlling current to the resistance heating member 100. In practice the blade temperature is maintained just above freezing at a temperature of the order of 2 to 10 degrees Celsius and preferably of the order of 4 to 6 degrees. In many cases where the player is off the ice for a short break as in regular shifts in a hockey game, the temperature of the box or other rest area is often sufficiently high that the heater is turned off during the break period off the ice and only turns back on when the player or skater is back on the ice for a sufficient period to cool the blade down to the temperature below the set temperature. This ensures that the heater is used only when required on the ice and the battery power is not wasted when the player is off the ice. This avoids the use of motion sensors or other timing devices to control the heat application.

The holder 3 defines an elongate bottom section 15 which extends along the full length of the holder and defines along a center thereof a slot 16 for receiving the blade. The elongate member 15 is connected to the hollow towers 4 and 5 so that the towers converge downwardly and inwardly from the top flange 6, 6A toward the bottom elongate member 15. At the bottom member 15, the moulded body forming the holder is solid and this solid structure extends upwardly into the structure of the holder until the width expands sufficiently to allow the structure to be formed into the hollow towers 4 and 5 while providing sufficient strength within the holder body from the moulded plastics material.

Between the hollow towers, the holder includes a U-shaped area 17 defining a top edge 18 which is the top edge of the solid part of the body on which the bottom member 15 is formed. The top surface 18 curves upwardly at the forward end to form a wall 21 which is the rear wall of the front tower 5. Similarly the top 18 at its rear curves upwardly to form a upward and forwardly extending portion 18B which forms the front wall of the rear tower 4. The front tower 5 thus has a rear end at the rear end of the flange 6 which overlies the surface 18 and symmetrically a forward end of the flange 6A of the tower 4 also overlies the surface 18.

The front tower 5 has a front wall 21 which extends downwardly to a forward end 22 of the member 15. The rear tower 4 has a rear wall 23 which extends downwardly to a rear end 24 of the member 15. The wall extending upwardly from the member 15 to the base of the towers includes side ribs which extend upwardly and rearwardly as indicated at 25 and 25A together with downwardly extending ribs 26 which connect from the inclined ribs 25 and 25A to the bottom end 15 to provide an attractive appearance.

Figure 6:
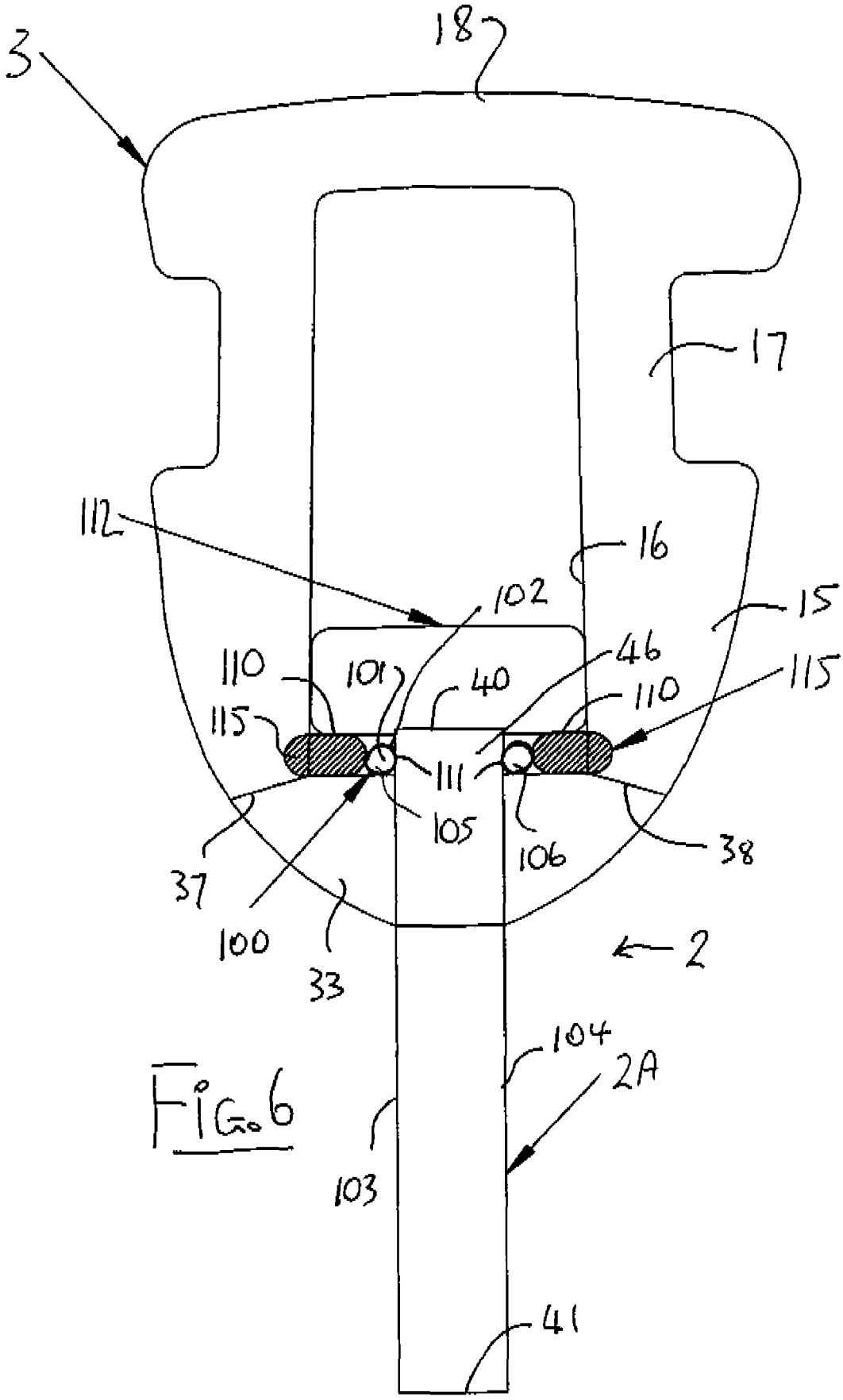
FIG. 6 is cross sectional view along the lines 6-6 of FIG. 4.
Figure 7:
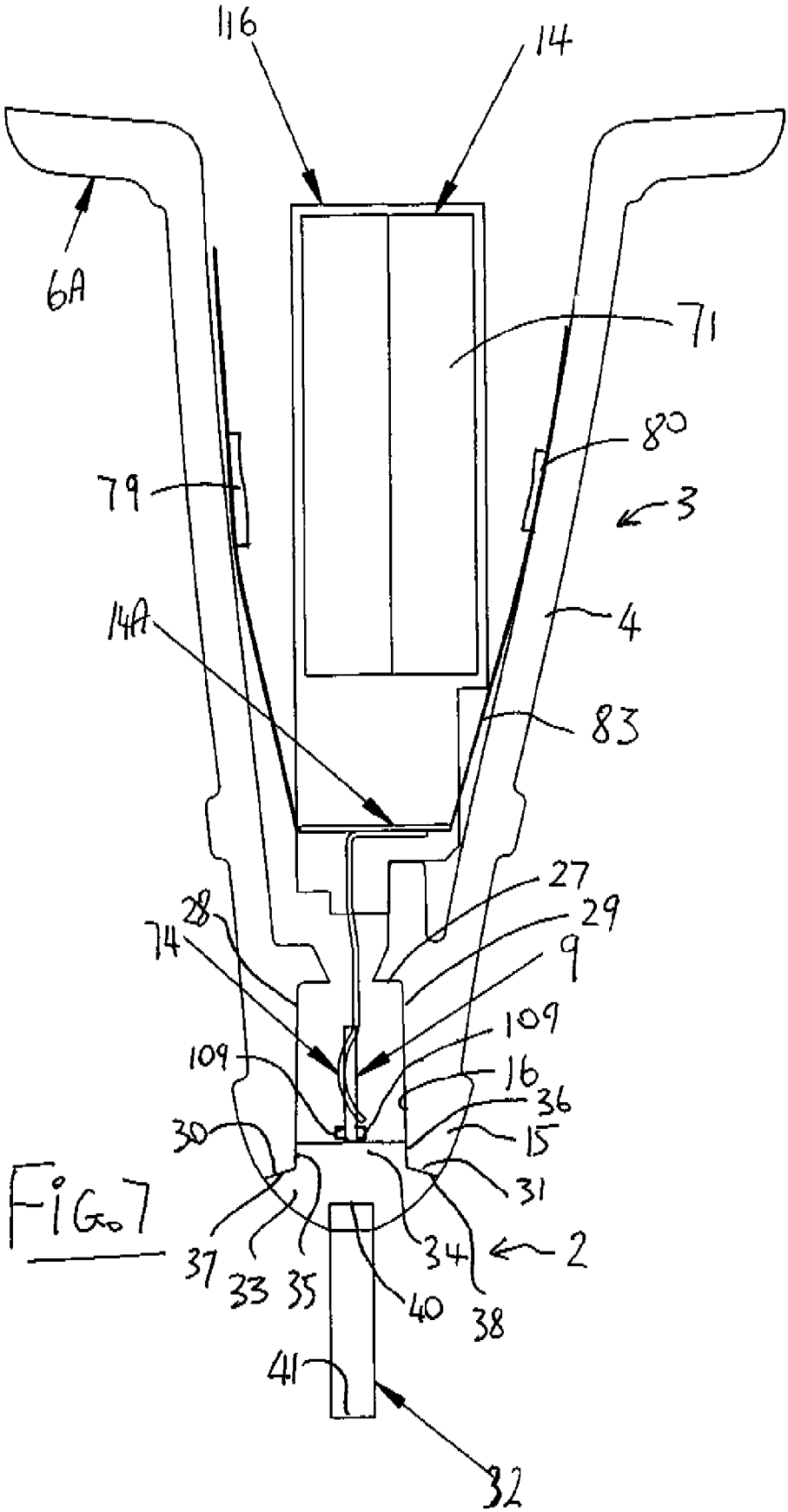
FIG. 7 is cross sectional view along the lines 7-7 of FIG. 4.

As best shown in the cross sectional views of FIGS. 6 and 7, the member 15 defines a slot 16 in its bottom surface with the slot 16 extending upwardly to an upper end 27 and defining two side walls 28 and 29 of the slot. The slot extends only partly across the width of the member 15 so that two shoulders 30 and 31 are formed at the bottom of the member 15 on either side of the slot 16. This slot provides a receptacle for the blade so that the blade may be inserted into this slot and pulled up into the slot to be held in fixed position on the bottom of the member 15 and held against side to side movement by engagement between the blade and the slot.

The blade 2 includes a steel blade portion 32 and an over-molded portion 33 of a plastics material. The over-moulded portion is moulded onto the sides of the steel blade 32 and across the top edge of the steel blade 32 so as to form a structural member rigidly and permanently attached to the steel blade and extending out to each side of the steel blade. Thus as shown for example in FIG. 7, the steel blade 32 engages into the over-molded plastics portion 33 so that it is held in place within that plastics portion. The plastics portion 33 includes a projecting element 34 with sides 35 and 36 which engage into the slot 16. The over-molded portion 33 includes top shoulders 37 and 38 which engage against the shoulders 30 and 31 of the bottom surface of the member 15.

Figure 3:
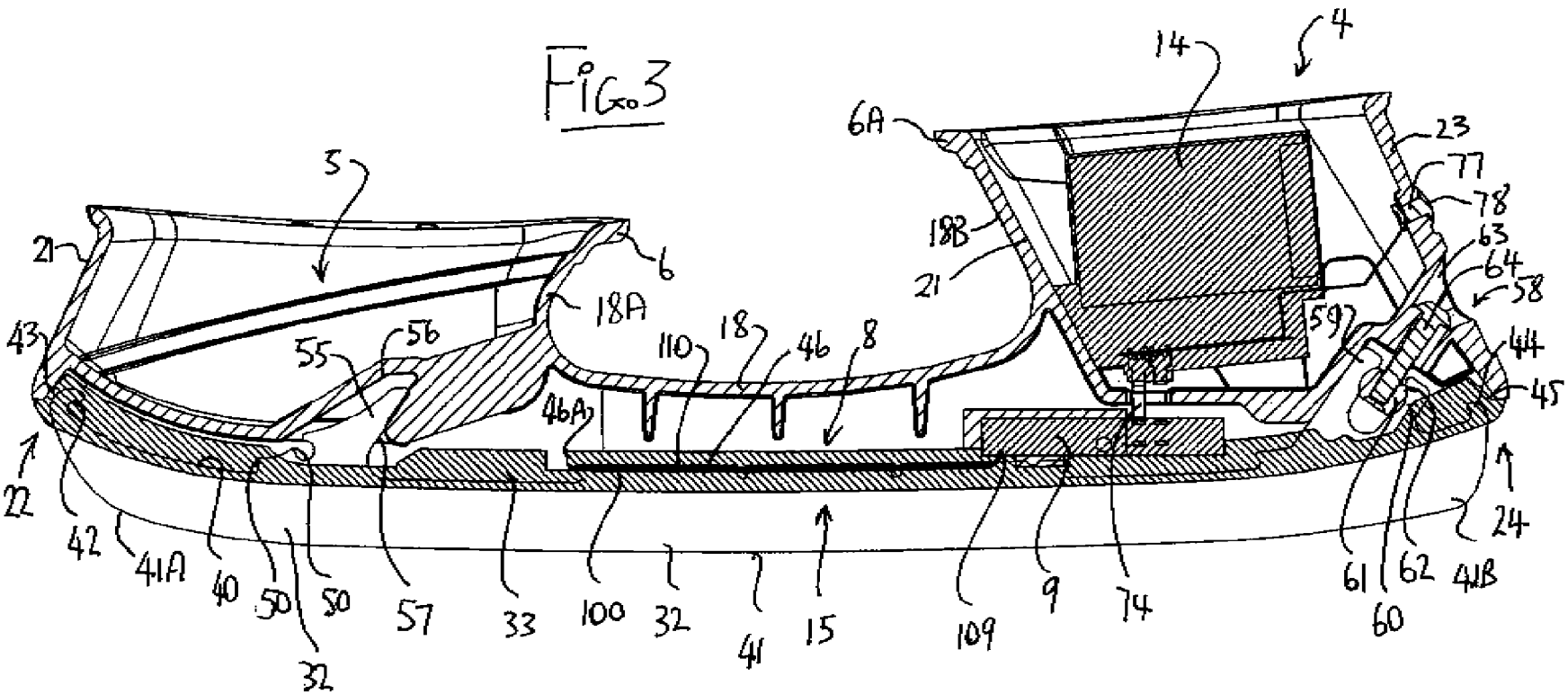
FIG. 3 is a longitudinal cross sectional of the embodiment of FIG. 1.

As best shown in FIG. 3, the steel blade 32 includes a top edge 40 which has a complex shape for engagement into the over-molded plastics portion 33. The steel blade 32 has a bottom edge 41 which forms the skate blade edge of a conventional shape with slightly upwardly curved front and rear portions 41A and 41B.

The complex upper edge 40 of the steel blade portion is shaped to define a series of hooks which engage into the over-molded plastics portion 33 to maintain permanent engagement therewith. Thus there is a front hook 42 at the forwardmost end of the steel blade and this is received just behind the front edge 43 of the over-molded plastics piece so that it is embedded in the plastics piece and acts to retain the blade within that plastics piece. Similarly there is a rear hook 44 which engages into the plastics piece just in front of the rear edge 45 of the over-molded plastics piece.

The steel blade further includes upwardly projecting element 46 in the center section under the surface 18 which projects into the area at the heating element 8. Further upwardly projecting portions 50 at spaced positions along the length of the blade also provide further engagement into the plastics material. The thermistor 12 is mounted on the circuit board 9 in contact with the blade 32.

Thus at some locations as shown in FIG. 7 for example, the blade extends only a short distance into the plastics material. However at other locations along the blade, the blade extends through the moulded portion 33 to provide components projecting beyond the plastics portion. At the location of the resistance heating member 100, the top edge 46 of the blade is elevated relative to that at other locations to provide a portion along which the resistance heating member 100 can engage.

Figure 4:
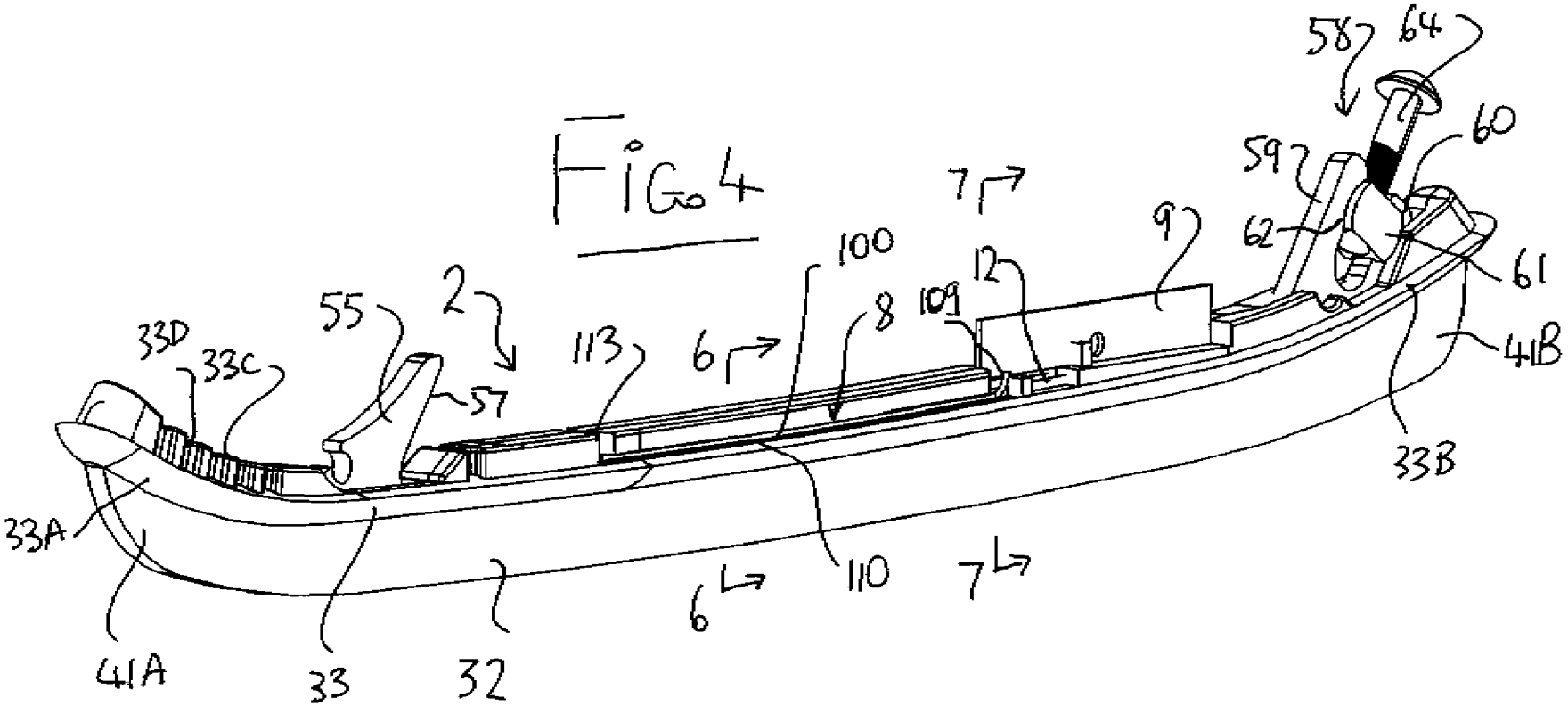
FIG. 4 is an isometric view from one side of the skate blade member of the embodiment of FIG. 1.

Thus as best shown in FIGS. 3 and 4, the steel blade includes a front engagement portion 55 which projects through the over-molded plastics portion 33 to provide an engagement hook member which extends into a receptacle 56 in the support. The hook member 55 has a rear surface 57 which extends upwardly and rearwardly so as to butt against a correspondingly inclined surface of the receptacle 56. It will be appreciated therefore that rearward pulling action on the blade member 2 will cause the inclined surfaces to pull the blade upwardly into the slot 16 so as to force the shoulders of the blade against the shoulders at the base of the member 15.

The rearward pulling action on the blade is provided by a rear mounting member 58 of the blade. The rear mounting member 58 also projects upwardly through the over-molded plastics member 33 to provide an upwardly extending portion above that member. The rear mounting 58 includes two arms 59 and 60 between which is mounted a nut 61 received in a cylindrical bearing surface 62 allowing the nut to swivel about an axis at right angles to the axis of the nut. Thus the nut has a cylindrical outer surface which is contained within the cylindrical bearing surface 62 allowing this pivotal action to accommodate slight inaccuracies in the positioning of the blade relative to the holder. The rear wall 23 of the rear tower 4 has a recessed hole 63 for receiving a screw 64. The screw has a head which engages against a base of the recessed hole so that the screw can engage into the nut and by turning the screw the nut is pulled upwardly and rearwardly as the screw head butts against the shoulders on either side of the hole. Thus the turning of the screw 64 acts to pull the blade upwardly and rearwardly along the slot 16 so as to pull the rear part of the blade into the slot and so as to pull the blade rearwardly along the slot to force the front mounting portion 55 into the receptacle 56.

Thus the blade can be mounted on the holder by releasing the screw and by removing the projecting portion of the moulded plastics portion 33 from the slot by pulling the blade downwardly. The blade can be reinserted by simply inserting the blade approximately into its required position thus sliding the front member 55 into the receptacle 56 whereupon the screw and be inserted into the nut and the blade pulled up into place both longitudinally and upwardly.

As shown for example in FIG. 71 the sides of the portion 33 within the slot are slightly tapered and the side walls of the slot itself are slightly tapered so as to provide a friction fit between the plastics parts as the blade is pulled upwardly. Thus the blade is pulled upwardly until the shoulders engage between the shoulders on the side of the plastics portion 33 and the shoulders at the base of the member 15. In this way a rigid mounting is provided by the engagement of the shoulders which prevent further upward movement and by the engagement of the tapered sides which prevent side to side slopping movement of the blade within the slot at the base of the member 15. In other words the top part of the moulded member 33 which engages into the sides of the slot provides a wedging action which resists side to side movement.

As best shown in FIG. 2, the bottom edge 41 of the blade curves upwardly and forwardly at the front end 41A and curves upwardly and rearwardly at the rear end 418. The over-molded portion 33 similarly is curved upwardly at the forward end at 33A and is curved upwardly at the rearward end as indicated at 33B. Also following the same curvature, the bottom edge of the member 15 also curves upwardly and forwardly at the forward end indicated at 15A and upwardly and rearwardly at the rearward end indicated at 15B. In this way the blade and the over-molded portion 33 fit effectively into the slot 16 of the member 15 along the full length of the blade.

Figure 5:
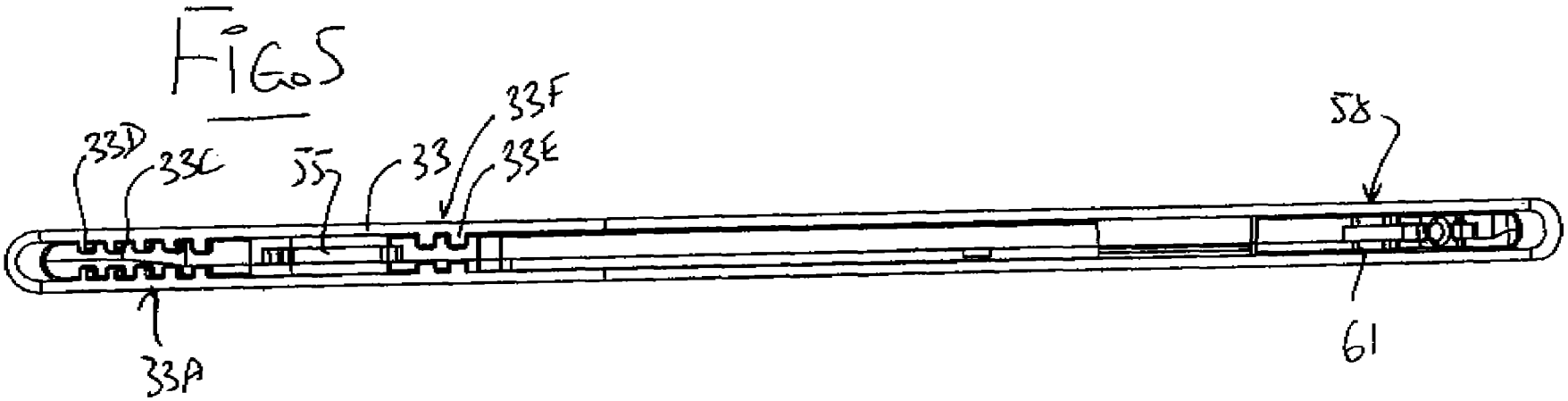
FIG. 5 is a top plan view the blade of FIG. 4.

As best shown in FIGS. 4 and 5, that part of the over-molded portion 33 which projects above the top edge of the blade 40 in the region of the front curved section 33A has the sides of the over-molded portion 33 castellated as indicated at 33C to provide a series of upstanding slots 33D in the sides. The slots 33D are provided in each side of the over-molded portion and extend down to a depth between the slots approximately equal to the width the blade. These slots are thus formed in the plastic part above the top edge of the blade and extend downwardly to the top edge of the blade. These castellated slots have been found to allow the mounting of the blade into the slot 16 in a manner which reduces vibration of the blade during vigorous stopping actions by the skater. They also add to the stiffness of the blade without adding too much weight.

Turning now to FIGS. 1 and 2, the towers 4 and 5 are arranged to extend upwardly to a position to engage the bottom of a conventional skate boot. It will be appreciated that in practice the heated skate blade arrangement of the present invention can be constructed as a separate item for attachment to boots manufactured by skate manufacturers so that the heated skate itself can be supplied to a number of different manufactures for use with their skate boots.

The tower 5 at the front is of reduced height relative to the tower 4 at the rear. Thus as is conventional the heel part of the boot is elevated above the toe part of the boot allowing the top flanges 6 and 6A to be attached directly to the bottom surface of the boot without the presence of a heel structure underneath the boot between the rear part of the boot and the top flange 6A.

The flange 6 surrounding the tower 5 is shaped so as to follow approximately the shape of the sole part of the boot and thus is slightly wider than the heel part of the boot at the flange 6A of the tower 4.

Each of the flanges includes a series of holes along the flanges on each side of the hollow tower and these holes are arranged to be fastened to the boot by rivets engaged through the flange from the underside and engaging into the receiving holes in the base of the boot.

Thus the sole has four receiving holes along each side for receiving the four holes of the flange 6. The rear part of the boot has three receiving holes on each side for receiving the rivets from the flange 6A.

The holes 7 in the front tower include some oblong holes or elongate holes 7A on the front flange 6 which are elongated in a direction side to side which are the third ones from the front of the tower 5. The holes 7 in the rear tower 4 include some oblong holes or elongate holes 7B on the rear flange 6A which are elongated in a direction front to rear direction which are the middle ones of tower 4). This allows adjustment of the position of the flange on the base of the boot so as to allow slight side to side and front to rear movement of the mount for the skate blade relative to the boot for improved alignment and ease of installation.

As best shown in FIGS. 4 and 6, the resistance heating member 100 is formed by an elongate electrically conductive cylindrical wire 101 of constant cross-section along which the current from the battery power source is conducted with a layer 102 of electrically insulating material applied onto an outside peripheral surface of the wire. The wire is formed of a high resistance alloy so that the resistance is significantly greater than a comparable wire of copper so generate a significant heat output. Typical heating wires of this type are available from Isabellenhutte and are typically used for floor heating. In a suitable example the wire has a thickness of 32 gauge, 150 mm long, which in conjunction with a battery voltage of 7.4V typical can produce a heat output of 7.4 watts which is suitable for applying the required heat to the skate blade.

The wire 101 extends in a substantially straight path along the side surfaces of the skate blade member and the wire is held against the side surfaces 103 and 104 of the blade 32 so that the layer 101 is held in direct contact with the surface of the blade to transfer heat thereto.

The wire 101 includes a first portion 105 along the first side surface 103 of the skate blade member and a second portion 106 along a second opposed side surface 104 of the skate blade member, both being arranged close to the top edge 40 but spaced slightly downwardly from the top edge. The wire extends in a loop from a first electrical connection 108 on one side of the heating control circuit board 9 along the first side surface of the skate blade member, wraps around the end 46A of the raised section 46 of the blade 40 and returns along the second opposed side surface of the skate blade member to a second connection 109 on the other side of the heating control circuit board 9. The circuit board 9 is located directly at the end of the raised portion 46 at the top of the blade at a location where the top edge 40 of the blade 32 is recessed downwardly as shown in FIG. 7.

As best shown in FIGS. 4 and 6, the over-molding 33 of plastics material is shaped in the molding to define a longitudinally extending groove 110 on each side with a base 111 of the groove at the surface of the metal skate blade. The groove is formed between a bottom piece of the over-mold 33 and a top piece 112 which extends across on top of the blade over the top edge 40. The top piece 112 and the remainder of the over-molding 33 are integrated at the end 46A of the raised portion 46 of the blade opposite the board 9 as indicated at 113 where the wire loops around the end 46A of the portion 46 cross the over-molding 33.

The groove has a width equal roughly to the diameter of the wire and the resistance heating member in the form of the wire is received in the groove at the base 111 in contact with the respective side surface of the blade.

The resistance heating member in the form of the wire 101 is compressed into the groove against the surface of the blade at the base by a deformable bead 115 of a resilient plastics material. The deformable bead 115 of resilient material is compressed by insertion of the over-molding into the slot 16 of the support 15 so that the sides 28 and 29 of the slot apply pressure against an outwardly projecting portion of the bead to apply pressure on the deformable bead. In this way the resistance heating member in the form of the wire is compressed against the surface of the skate blade member at the base of the groove by the deformable bead, which is formed of a heat insulating resilient material of a hardness of for example 73 Shore A.

In this way, the resistance heating wire has one side in contact with the skate blade member and all other sides surrounded by heat insulating plastics material defined by the over-molding 33 and the bead 115.

As an alternative to the provision of two wire portions along the side surfaces of the blade, there may be provided only a single wire in a single groove with that groove located at one side or on top of the blade The battery power supply 14 includes a battery 71 and the battery control circuit board 14A located underneath the battery and including a conventional battery protection circuit which is part of the battery since the batteries are sold with this little circuit incorporated in the battery enclosure. The battery control circuit 14A carries the components for controlling the supply of power from the battery including a low power indicator. The battery 71 and the circuit board 14A are contained within an encapsulating material 116 to form an enclosed separate item which can be inserted into the hollow tower as an integral element to be contained therein. The encapsulated battery power supply includes a pair of terminals 74 one of which can be seen in FIG. 7 which extend downwardly from the battery side by side as spring wire contacts and which are arranged to be connected to the board 9 for communication of current from the battery power supply to the heat control circuit 9 carried on the blade.

As previously described, the blade itself can be removed from the mounting and thus the terminals 74 comprise spring-finger type wires or fingers which engage onto fixed terminals on the circuit 9. Thus simple upward pressure of the board 9 onto the spring fingers 74 as the skate blade member is inserted into the support at the required location causes the engagement between the terminals 74 and the requisite terminal on the circuit 9. The battery power supply further includes a further terminal 76 in the form of a spring finger which extends from one end of the battery control circuit board for engagement with a stud or rivet 77 carried in the tower as best shown in FIG. 3 where the stud has a head 78 exposed at the rear wall 23 of the tower for engaging a charging system.

A charging system for the skate can therefore comprise components which have a first terminal for engagement with the blade 32 and a second terminal for engagement with the head 78 of the stud 77. This provides a connection to the battery power supply through the battery control circuit 14A.

The circuit board 9 is thus contained within the slot 16 above the shoulders 37 and 38 and is encapsulated in this area by a suitable low pressure molding material which engages over the board 9 on top of the high pressure structural over-molding 33. The board 9 is also contained within the tower 4 of the support so that it is fully enclosed both by its own encapsulation and by the surrounding structure of the support.

The battery power supply 14 is contained within the rear tower 4 above the elongate member 15 of the support and within the enclosed tower 4. The flange 6A is sealed to the underside of the skate boot with the battery power supply 14 in place. The sealing action can be provided by a gasket which overlies the flange 6A to provide an effective sealing action to prevent the penetration of moisture from the ice or from the environment into the rear tower 4 and thus into the area of the battery power supply. The rear tower 4 is fully enclosed and sealed without any openings for switches or connections since the tapered shoulder 33 seals with the base of the bottom support 15 when the screw 64 is tightened, apart from the stud 77 which is itself sealed into a hole in the rear wall 23 of the tower 4.

In order to avoid unnecessary openings into the hollow rear tower 4, the manually operable switch arrangement for activating the power supply is defined by a pair of proximity switches 79 and 80 mounted on a flexible circuit board 83 the inside surface of the hollow rear tower 4 at sides of the tower at a position where the fingers and thumb of a user can reach around the rear wall 23 to squeeze together on respective side of the hollow rear tower to engage the areas of the tower at the proximity switches 79 and 80. The use of two proximity switches one on each side prevents inadvertent operation of the switch actuating the power supply by contact with an extraneous item such as a puck or other elements such as an opponent's stick. Thus the actuation of the switch occurs only in the event that both proximity switches are activated simultaneously and are touched for a required period of time. Thus the microprocessor may be programmed that the sensors must be touched for a predetermined minimum period of time or in a pattern like a computer mouse double click, that is they may be touched for at least predetermined minimum period of time but not more than a predetermined maximum period of time then released for at least predetermined minimum period of time but not more than a predetermined maximum period of time and then touched for at least a predetermined period of time which is an extremely unlikely event unless controlled by the user reaching to the proximity switches by a finger and thumb.

The use of the proximity switches avoids the penetration of the tower 4 so that there is no possibility for moisture penetration through openings at the switches. Proximity switches are commonly available and utilize the electrical changes effected by bringing the finger or thumb into close proximity with the electrical component on the inside surface.

An indicator light or LED for indicating the activation of the power supply is visible on the exterior of the tower 4 and is provided at the location 81 visible on both sides of the blade indicated on FIG. 2. The LED itself is shown in FIG. 3 as indicated at 82. At this location the plastics material forming the moulded skate support is made sufficiently thin that the illumination from the LED is visible on both sides through the plastics material without the necessity for a penetration of the LED itself through the plastics material. In the arrangement shown the LED is located at a position just above the top edge of the blade 32 in the area just above the elongate support 15 and just behind the central heated area of the skate blade. The LED may itself be located within the tower on one or other side adjacent the proximity switches 79 and 80.

The arrangement described above provides a number of advantages as follows:

The heating wire has both its ends protected against moisture by the over-molding low pressure encapsulating plastic material covering the board 9. The wire is continuous and unbroken in its loop from the ends.

The heating element, in the form of the wire or other resistance heating element is compressed against the steel blade with the extrusion or bead compressed between it and the holder.

The battery 14 and electronics 14A are protected against moisture with plastic over-moulding. As an alternative to the over-molding using low pressure molded plastics material it is also possible to use conventional potting materials.

The two proximity sensors are used to actuate the power to avoid inadvertent action. They have a pattern so that the player must hold his fingers there for a given amount of time (minimum X seconds, maximum Y seconds) so that it eliminates turning on or off accidentally.

The connections provided use the steel blade and a rivet to transfer the electricity from a charger to charge the battery.

The spring loaded contacts 74 act to transfer the electricity from the battery pack to the heating device. This allows us to easily change the blade when it has been sharpen too many times.

The spring loaded contact 77 acts to transfer the electricity from the battery to the rivet.

The mechanical features of the slotted holes 7A in the flanges, the tapered joint 16 between over-molded steel blade and the support or holder and the anti-vibration ribs 33C on the over-molded steel blade provide an effective mounting of the blade on the boot.

The invention claimed is:

1. A skate blade assembly comprising:

a skate blade member;

a support for the skate blade member for attachment of the skate blade member to a skate boot;

a resistance heating member extending along a surface of the skate blade member for applying heat to the skate blade member;

a battery power source carried on the support for supplying current to the resistance heating member;

the resistance heating member comprising an elongate electrically conductive straight wire of constant cross-section along which the current from the battery power source is conducted;

the straight wire having a cylindrical layer of electrically insulating material surrounding an outside peripheral surface of the wire, the wire extending in a substantially straight path along the surface of the skate blade member and the wire being against the surface so that one side of the cylindrical layer is held in direct contact with the surface to transfer heat thereto;

wherein the skate blade member includes a metal skate blade with an over-molding of plastics material applied on at least one side surface of the blade so as to form a raised band of the plastics material along the side surface of the blade with an outer surface of the plastics material spaced outwardly from the side surface of the blade, wherein the plastics material includes a groove extending from an open mouth of the groove at the outer surface of the plastics material to a base of the groove at the side surface of the blade and wherein the resistance heating member is received in the groove;

wherein the over-molding of plastics material extends along both sides of the metal skate blade with the plastics material forming on each side of the metal skate blade a respective groove with a base of the groove at the side surface of the metal skate blade and wherein a portion of the resistance heating member is received in each groove;

and wherein the wire is compressed into the groove by a deformable strip of a resilient material.

2. The skate blade according to claim 1 wherein the conductive wire forming the resistance heating member is circular in cross section.

3. The skate blade according to claim 1 wherein the resistance heating member includes a first portion along a first side surface of the skate blade member and a second portion along a second opposed side surface of the skate blade member.

4. The skate blade according to claim 1 wherein there is provided a heating control circuit board arranged above the skate blade member and the straight wire extends from a first electrical connection at the heating control circuit board along a first side surface of the skate blade member and returns along a second opposed side surface of the skate blade member.

5. The skate blade according to claim 1 wherein the over-molding of plastics material along the skate blade member forms a mounting therefor into the support.

6. The skate blade according to claim 1 wherein the over-molding of plastics material along the skate blade member forms a mounting therefor into the support and wherein the deformable strip of resilient material is compressed by insertion of the over-molding into the support.

7. A skate blade assembly comprising:

a skate blade member;

a support for the skate blade member for attachment of the skate blade member to a skate boot;

a resistance heating member extending along a surface of the skate blade member for applying heat to the skate blade member;

a battery power source carried on the support for supplying current to the resistance heating member;

the resistance heating member comprising an elongate electrically conductive straight wire of constant cross-section along which the current from the battery power source is conducted;

the straight wire having a cylindrical layer of electrically insulating material surrounding an outside peripheral surface of the wire, the wire extending in a substantially straight path along the surface of the skate blade member and the wire being against the surface so that one side of the cylindrical layer is held in direct contact with the surface to transfer heat thereto;

wherein the wire is compressed against a surface of the skate blade member by a deformable strip of a resilient material.

8. The combination according to claim 7 wherein the wire has one side in contact with the skate blade member and all other sides surrounded by a heat insulating plastics material.

9. The skate blade according to claim 8 wherein the wire is contained within a groove formed in a layer of a plastics heat insulating material attached to the skate blade member and is held into the groove by a strip of a plastics heat insulating material.

10. A skate blade assembly comprising:

a skate blade member;

a support for the skate blade member for attachment of the skate blade member to a skate boot;

a resistance heating member extending along a surface of the skate blade member for applying heat to the skate blade member;

a battery power source carried on the support for supplying current to the resistance heating member;

wherein the resistance heating member has one side in contact with the skate blade member and all other sides surrounded by a heat insulating plastics material;

wherein the resistance heating member is contained within a groove formed in a layer of a plastics heat insulating material attached to the skate blade member and is held into the groove by a deformable strip of a plastics heat insulating material.

11. A skate blade assembly comprising:

a skate blade member;

a support for the skate blade member for attachment of the skate blade member to a skate boot;

a resistance heating member extending along a surface of the skate blade member for applying heat to the skate blade member;

a battery power source carried on the support for supplying current to the resistance heating member;

wherein the skate blade member includes a metal skate blade with an over-molding of plastics material applied on at least one side surface of the blade so as to form a raised band of the plastics material along the side surface of the blade with an outer surface of the plastics material spaced outwardly from the side surface of the blade;

wherein the plastics material is shaped to form a groove extending from an open mouth of the groove at the outer surface of the plastics material to a base of the groove at the side surface of the blade;

and wherein the resistance heating member is received in the groove;

wherein the resistance heating member is compressed into the groove by a deformable strip of a resilient material.

12. The skate blade according to claim 11 wherein the over-molding of plastics material is arranged along both sides of the metal skate blade with the plastics material being shaped to form on each side of the metal skate blade a respective groove with a base of the respective groove at the side surface of the metal skate blade and wherein a portion of the resistance heating member is received in each groove.

13. The skate blade according to claim 11 wherein the over-molding of plastics material along the skate blade member forms a mounting therefor into the support.

14. The skate blade according to claim 11 wherein the over-molding of plastics material along the skate blade member forms a mounting therefor into the support and wherein the deformable strip of resilient material is compressed by insertion of the over-molding into the support.

15. A skate blade assembly comprising:

a skate blade member;

a support for the skate blade member for attachment of the skate blade member to a skate boot;

a resistance heating member extending along a surface of the skate blade member for applying heat to the skate blade member;

a battery power source carried on the support for supplying current to the resistance heating member;

wherein the resistance heating member is compressed against a surface of the skate blade member by a deformable strip of a resilient material.

16. The skate blade according to claim 15 wherein the deformable strip of resilient material is compressed by insertion of the skate blade member into the support.

* * * * *